United States Patent [19]

Ranauro

[11] 4,175,776

[45] Nov. 27, 1979

[54] COUNTERFEIT RESISTANT DOCUMENT

[75] Inventor: Carmine J. Ranauro, Arlington, Mass.

[73] Assignee: New England Mutual Life Insurance Company, Boston, Mass.

[21] Appl. No.: 867,117

[22] Filed: Jan. 5, 1978

[51] Int. Cl.[2] ..... B42D 15/00

[52] U.S. Cl. ..... 283/8 B; 283/17; 283/58; 428/211

[58] Field of Search ..... 283/8 R, 8 B, 17, 58; 428/211

[56] References Cited

U.S. PATENT DOCUMENTS

| | | | |
|---|---|---|---|
| 1,002,600 | 9/1911 | Morris et al. | 283/8 B |
| 1,692,405 | 11/1928 | Freeman | 283/8 R |
| 2,255,696 | 9/1941 | Clifford | 283/8 B |
| 3,597,082 | 8/1971 | James et al. | 283/17 |
| 3,675,948 | 7/1972 | Wicker | 283/8 B |
| 3,713,861 | 1/1973 | Sharp | 283/8 B |
| 3,852,088 | 12/1974 | Godlewski | 283/8 R |
| 3,887,742 | 6/1975 | Reinnagel | 283/8 R |

*Primary Examiner*—Leonidas Vlachos

*Attorney, Agent, or Firm*—Kenway & Jenney

[57] ABSTRACT

A counterfeit resistant document having a set of indicia on a background field. The set of indicia and the background field are characterized by different optical reflectivities for incident light having wavelengths within the response spectrum of the human eye, and are substantially non-absorbing with respect to incident light having wavelengths within the response spectrum of color xerographic copying machines. The document includes two types of ink particles deposited on a substrate, with the types of ink particles having different, non-uniform spatial distributions over the background field, and at least a first type being substantially non-absorbing with respect to light in the response spectrum of a color copier. The distributions define the indicia set by providing that substantially no ink particles of the first type overlie the substrate within the contours of the indicia, and particles of that type immediately surround those contours, so that a uniform optical reflectivity is present over the indicia and immediately surrounding the background field for incident light having wavelengths within the copier spectrum.

6 Claims, 3 Drawing Figures

COUNTERFEIT RESISTANT DOCUMENT

BACKGROUND OF THE INVENTION

This invention relates to documents and more particularly to counterfeit resistant documents suitable for use as negotiable instruments.

Certain negotiable instruments used in commerce, such as bank drafts, are often printed with black ink on rectangular sheets of paper having a multicolor background. As negotiable instruments, these documents include indicia representative of such transaction parameters as the date, account number, amount, payee, drawer and drawee bank. Commercial practice has generally established procedures to minimize fraudulent activity with respect to such documents, particularly, in view of recently developed computer-based banking systems and credit authorization systems and the like. Such systems can provide a rapid verification of account numbers, account balances and in some cases signature verifications.

However, such documents may readily be copied using conventional black and white copiers and colored stock matching the background of the original document. With the advent of color xerographic copying machines, it is now possible for a party to directly make counterfeit copies of multicolor background documents, such as bank drafts, and fraudulently present those copies for payment. To counteract this fraudulent activity, the prior art relies largely on the ability of the party presented with a draft, a teller for example, to detect the counterfeit documents as such from a visual scan of the document. As technological advances have improved the quality of color xerographic copiers so that reproduced documents bear a closer resemblance to the original, this counterfeit detection task has become increasingly difficult.

It is accordingly an object of the present invention to provide a counterfeit resistant document suitable for use as a negotiable instrument, such as a bank draft.

SUMMARY OF THE INVENTION

The present invention is a counterfeit resistant document having a set of indicia on a background field. The set of indicia and the background field are characterized by different optical reflectivities with respect to incident light having wavelengths within the response spectrum of the human eye, and are substantially non-absorbing with respect to incident light having wavelengths within the response spectrum of a color xerographic copier. The document includes a substrate underlying the set of indicia and the background field. The substrate has a surface which is non-absorbing with respect to incident light within the response spectrum of a color copier. In some embodiments, the substrate surface absorption spectrum may be established by a uniform ink coating.

In accordance with the invention, the substrate surface carries at least two types of ink particles deposited over the background field with different non-uniform distributions. At least one ink particle distribution defines the set of indicia by providing that substantially no ink particles overlie the substrate within the contours of the indicia, and providing a plurality of ink particles on the substrate adjacent to and exterior to the contours of the indicia, thereby establishing "reverse" printing of the indicia. The ink particles of the indicia-defining distribution are substantially non-absorbing with respect to incident light within the copier spectrum so that the composite optical reflectivity determined by the substrate and those ink particles is substantially uniform over the set of indicia and over the immediately surrounding background field for a color xerographic copier. The several types of ink particles each have characteristic optical absorption spectra which are different from each other and also from the substrate with respect to incident light having wavelengths within the response spectrum of the human eye.

With this configuration, a human observer can readily detect the set of indicia since the set appears to be "reverse" printed against the background field (due to the difference in reflectivity of the substrate with respect to the ink particles in the background field within the human eye response spectrum). However, when the document is presented for copying at a color xerographic copier, the incident light used in the copying process produces a uniform reflected pattern over the indicia and background field so that the indicia substantially "drop out" of the copied document. As a result, an attempt to counterfeit the subject document through the use of a color xerographic copier would be ineffective since the information on the document represented by the set of indicia would be missing from the resultant document copy.

The other ink particle distribution (or distributions) provides regions of different color to the human eye from the regions having ink particles of the first type. In various embodiments, the absorption spectra for these ink particles may be either within or outside the copier response spectrum.

In practice, the invention may be utilized in the form of a bank draft wherein the set of indicia are representative of the drawee bank, for example, or any other of the critical information required for a negotiable instrument under the Uniform Commercial Code. Since the omission of any of this information removes the document from the classification as a negotiable instrument, the remaining information for the bank draft may be printed in standard fashion in ink which can be readily reproduced by a copying machine.

In alternative embodiments, the bank draft can include a second background field which is substantially non-absorbing within the copier response spectrum, but where a second set of indicia (such as the date or the drawer) is printed with ink particles which have substantially the same optical reflectivity as the substrate with respect to incident light having wavelengths within the response spectrum of the copier.

As a consequence of the non-uniformity of the two (or more) types of ink particles deposited on the background field, a counterfeiter has a difficult time providing a duplicate match of the two types of ink particle distributions, whether using a color xerographic copier or alternatively a color offset or screening process.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
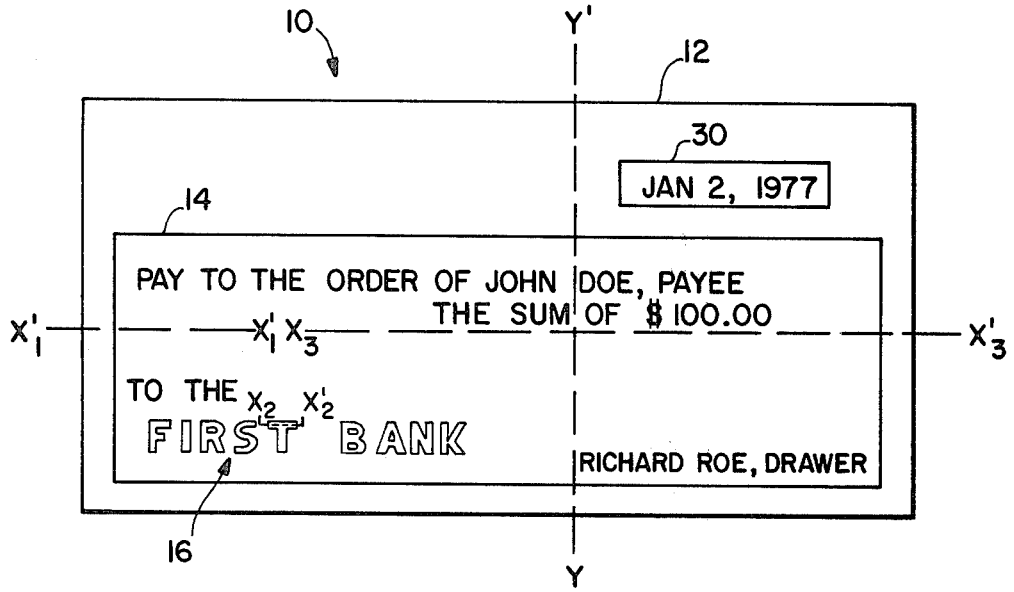
FIG. 1 shows an exemplary embodiment of a document in accordance with the present invention.

FIG. 1 shows a counterfeit resistant document 10 in accordance with the present invention. Document 10 includes a conventional paper stock substrate 12 having a background field 14 surrounding a set 16 of indicia "FIRST BANK 0-00/000". In the illustrated embodiment, the document has the form of a bank draft and includes indicia required by the Uniform Commercial Code for a negotiable instrument. The set of indicia "FIRST BANK 0-00/000" represents the drawee bank.

The illustrated document 10 includes two types of ink particles half-tone screened on the substrate 12 throughout the background field 14 with different, non-uniform spatial distributions. In this embodiment, the particle distribution (i.e. ink particle surface density on substrate 12) for each ink type is substantially uniform from top to bottom in background field 14, except within the contours of the indicia representative of the drawee bank. In alternative embodiments, the ink particle distributions may vary in either or both the top-to-bottom or left-to-right directions.

Figure 2:
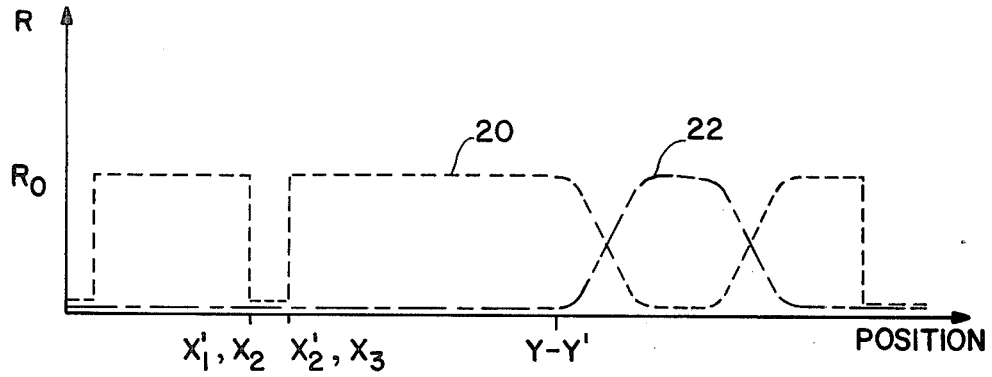
FIGS. 2 and 3 show exemplary ink particle optical reflectivity characteristics for the document of FIG. 1.

Dotted line 20 of FIG. 2 illustrates the variation in optical reflectivity R (i.e. the ratio of reflected-to-incident light for a unit surface area) at a wavelength within the response spectrum of a color xerographic copier for the distribution of a first type of ink particle on document 10 as a function of position from left to right along the line segments $X_1$–$X_1'$, $X_2$–$X_2'$ and $X_3$–$X_3'$ of FIG. 1. In the present embodiment, the substrate 12 is substantially non-absorbing with respect to light in the copier response spectrum, and is characterized by optical reflectivity $R_0$ with respect to incident light having wavelengths in the response spectrum of a color xerographic copier. In the present embodiment, the second type of ink particle is also substantially non-absorbing with respect to light having wavelengths within the copier response spectrum. Dot-dash line 22 of FIG. 2 illustrates the optical reflectivity of the second particle type at another wavelength within the copier response spectrum. The two types of ink particles that are non-uniformly distributed on substrate 12 are characterized by optical absorption spectra compared to each other and also to the substrate with respect to light having wavelengths within the response spectrum of the human eye.

With these exemplary distributions, the indicia representative of the drawee bank are "reverse" printed on the background field, i.e. the ink distribution over the background field 14 is adapted so that substantially no ink particles of the first type overlie the substrate within the contours of that set 16 of indicia, but a plurality of particles of that type overlie the substrate adjacent to and exterior to the indicia contours. To the left of line Y–Y' in FIG. 1, the reflectivity due to this first type ink particle distribution (represented by line 20) is relatively constant at $R_0$ within the copier response spectrum, except for the regions within the contours of the drawee bank indicia. However, in these regions, the substrate provides a reflectivity $R_0$ within the copier response spectrum so that the composite reflectivity over the entire background field 14 to the left of Y–Y' is substantially uniform and equal to the value $R_0$ for the substrate with respect to incident light having wavelengths within the response spectrum of the color copier. Since the second type ink particles are also reflective within the copier response spectrum, the composite reflectivity to the right of line Y–Y' is also $R_0$ within the copier response spectrum, so that a color copier produces a uniformly white background field 14 in this region, while a vertical stripe is perceived by the human eye.

Figure 3:
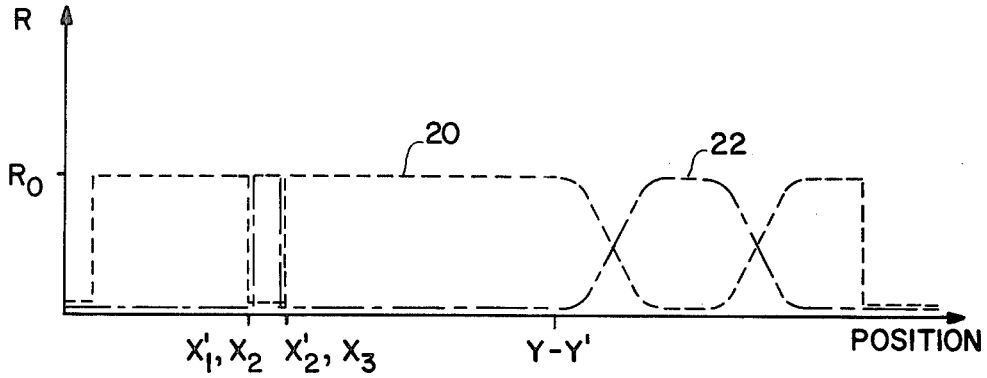

In alternative embodiments, the set 16 of indicia may be reverse printed against the background field by the distribution of ink particles whereby ink particles of the first type overlie the substrate immediately surrounding the indicia while particles of the second type overlie the substrate within the contours of the indicia. FIG. 3 shows ink particle distributions for one such alternative embodiment of document 10.

In the embodiment of FIG. 1, the remaining indicia within field 14 are printed in conventional fashion, i.e. with ink characterized by reflectivities differing from $R_0$ within the copier response spectrum. Alternative configurations might use more than two types of ink with corresponding distributions which provide uniform composite optical reflectivity over the background field within the copier response spectrum, and still further alternative embodiments may include additional reverse printed indicia.

By way of specific example, for the Type 6500 color copier, manufactured by Xerox Corporation, the first and second types of ink particles suitable for use with conventional white paper stock in the embodiment of FIG. 1 are characterized by the optical absorption spectra of Pantone Matching System colors PMS 243 and PMS 305, respectively. The ink particles may be screened onto substrate 12 with 10–15% screening density. These ink types appear as pale pastel colors (pink and blue, respectively) to the human eye. However, when the document is presented to a color xerographic copier, both the indicia set 16 and the background 14 reflect substantially all of the incident light used in the copying process and the resultant document copy appears to the human eye to be uniformly white, with the regions in the copy corresponding to ink coated areas in the original document substantially matching the substrate so that the reverse printed indicia set drops out. The remaining indicia which are printed on the original document in a conventional manner are reproduced by the color copier. As a result, even if the document of FIG. 1 is presented to a copier with stock pre-colored with PMS 243 and PMS 305 regions, the resultant document would not include the set of indicia 16. Other ink types can also be used, where the inks are selected for use with particular copiers, and in conjunction with human engineering criteria, such as aesthetic appearance.

In the present embodiment, the ink particles are printed by screening onto the background field. As a result of the two ink type background configurations, duplication of the document 10 by means of a color xerographic copier, or by a color offset process, would be relatively difficult to accomplish in a manner preventing the reverse printed indicia dropping out in the resultant counterfeit copy.

In the present embodiment, the reverse printed indicia set 16 is positioned at points where the first type ink (represented by line 20) provides a relatively constant reflectivity and where the reflectivity contribution by the second type ink (represented by line 22) is nil. In alternative embodiments, the reverse printed indicia set may be positioned at points in the distribution which vary, rather than at points of constant reflectivity. Embodiments of the former type are preferred however since there are minimal problems associated with the registration of the ink particle distributions in the original document preparation.

In alternative embodiments, a second set of indicia is printed on the substrate 12 in a second background field 30, with the second set of indicia being printed with one of the two types of ink utilized in the background field 14. Alternatively, a different type ink is used in field 30, with the latter ink having a reflectivity $R_0$ with respect to incident light having wavelengths in the response spectrum of a color copier. As shown in FIG. 1, the date is so printed in document 10. When exposed to a color xerographic copier, the date would drop out of the reproduced document, as well as the drawee bank indicia. In alternative embodiments, differing combinations of the critical data for negotiable instruments may be so printed either in field 14 or in both field 14 and field 30.

In still other embodiments, the second type ink is characterized by reflectivities less than $R_0$ at one or more bands within the copier response spectrum. In these embodiments, document copy produced by a color copier includes colored regions corresponding to the second ink type.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A counterfeit resistant document having a set of indicia on a background field wherein said set of indicia and said background field are characterized by different optical absorption spectra with respect to incident light having wavelengths within the response spectrum of the human eye, and are substantially non-absorbing with respect to incident light having wavelengths within the response spectrum of a color xerographic copier, said document comprising:

a substrate underlying said set of indicia and said background field, and having a surface which is substantially non-absorbing with respect to incident light having wavelengths within the response spectrum of a color xerographic copier, at least two types of ink particles deposited on said substrate surface over said background field with different non-uniform distributions, said ink particle distributions defining said set of indicia with at least one of said distributions providing substantially no ink particles overlying said substrate surface within the contours of said set of indicia and providing a plurality of ink particles on said substrate surface adjacent to and exterior to the contours of said set of indicia, wherein said ink particles of each of said types are characterized by optical absorption spectra different from each other and from said substrate surface with respect to incident light having wavelengths within the response spectrum of the human eye, and wherein the particles of said one distribution are substantially non-absorbing with respect to incident light having wavelengths within the response spectrum of a color xerographic copier.

2. The document according to claim 1 wherein said ink particles are screen printed on said background field with a density between 10% to 50% screen.

3. The document according to claim 1 wherein said first type ink particles are characterized by the PMS 243 optical absorption spectrum, and said second type ink particles are characterized by the PMS 305 optical absorption spectrum.

4. The document according to claim 1 wherein said first type ink particles are characterized by the PMS 305 optical absorption spectrum, and said second type ink particles are characterized by the PMS 243 optical absorption spectrum.

5. A document according to claim 1 having a second set of indicia on a second background field, said second background field overlying said substrate and characterized by said optical absorption spectrum of said substrate, and wherein said document includes ink particles of one or more of said types deposited on said substrate interior to said second background field only and only within the contours of said second set of indicia to define said second set of indicia.

6. A document according to claim 1 wherein said particles of at least one other distribution are substantially non-absorbing with respect to incident light having wavelengths within the response spectrum of a xerographic color copier, and wherein said other distribution provides a plurality of ink particles on said substrate surface within the contours of said set of indicia.

* * * * *